US011346023B2

(12) United States Patent
Harvey et al.

(10) Patent No.: US 11,346,023 B2
(45) Date of Patent: May 31, 2022

(54) FULLY-FORMED VOLUMETRICALLY WOVEN ARTICLE

(71) Applicants: Claire E. Harvey, Providence, RI (US); Emily K. Holtzman, Clifton Park, NY (US); Brooks W. Hagan, Little Compton, RI (US)

(72) Inventors: Claire E. Harvey, Providence, RI (US); Emily K. Holtzman, Clifton Park, NY (US); Brooks W. Hagan, Little Compton, RI (US)

( * ) Notice: Subject to any disclaimer, the term of this patent is extended or adjusted under 35 U.S.C. 154(b) by 0 days.

(21) Appl. No.: 16/938,863

(22) Filed: Jul. 24, 2020

(65) Prior Publication Data

US 2021/0025086 A1 Jan. 28, 2021

Related U.S. Application Data

(60) Provisional application No. 62/879,380, filed on Jul. 26, 2019.

(51) Int. Cl.
*D03D 25/00* (2006.01)
*D03D 11/02* (2006.01)
(Continued)

(52) U.S. Cl.
CPC ..... *D03D 25/005* (2013.01); *D03C 9/024* (2013.01); *D03D 11/02* (2013.01); *D03D 49/16* (2013.01); *D10B 2501/043* (2013.01)

(58) Field of Classification Search
CPC ..... D03D 25/005; D03D 11/02; D03D 49/16; D03D 3/08; D03D 1/00; D03C 9/024; D10B 2501/043
See application file for complete search history.

(56) References Cited

U.S. PATENT DOCUMENTS 3,603,353 A * 9/1971 Glass ..... D03D 47/342 139/370.2
4,943,927 A * 7/1990 Yarita ..... G05B 19/0421 139/1 R (Continued)

OTHER PUBLICATIONS

"Basics of weaving and woven fabrics"; https://www.textileschool.com/246/basics-weaving-woven-fabrics/; Apr. 8, 2018; accessed Jul. 28, 2021 (Year: 2018).*

*Primary Examiner* — Robert H Muromoto, Jr.
(74) *Attorney, Agent, or Firm* — Armis IP Law, LLC

(57) ABSTRACT

A volumetric weaving approach employs a vertical aspect of woven warp and weft fibers to generate volumetric structures through formation of tie-downs. Tie downs define warp and weft fibers that take a vertical path or component extending perpendicular to a weave plane. Independently controlled heddles provide selective warp fibers control, and a two-dimensional creel that dispenses the warp fibers at differing feed rates allows manipulation of the fibers into three dimensional structures or portions. As a shuttle draws the weft fiber, different layers are raised and lowered to lend a vertical axis to the resulting volumetric structure. Interconnections between the portions include the use of the tie downs to connect multiple portions to define 3-dimensional panels of a finished article such as a shoe. A single pass defining all the interconnected portions of the shoe generates the fully formed shoe without subsequent cutting and seaming of different textile panels.

17 Claims, 7 Drawing Sheets

(51) Int. Cl.
*D03C 9/02* (2006.01)
*D03D 49/16* (2006.01)

(56) References Cited

U.S. PATENT DOCUMENTS

| | | | | |
|---|---|---|---|---|
| 9,817,923 | B2 * | 11/2017 | Marchal | B29C 70/24 |
| 10,006,154 | B2 * | 6/2018 | Molnar | D03D 51/007 |
| 10,016,013 | B2 * | 7/2018 | Kormann | A43B 1/08 |
| 10,159,311 | B2 * | 12/2018 | Cai | A43B 23/025 |
| 10,342,289 | B2 * | 7/2019 | Bell | A43B 23/0275 |
| 10,465,315 | B2 * | 11/2019 | Molnar | D03C 19/005 |
| 10,499,701 | B2 * | 12/2019 | Cai | A43B 23/0245 |
| 2015/0071978 | A1 * | 3/2015 | Chang | A61N 2/06 424/402 |
| 2016/0047071 | A1 * | 2/2016 | Li | D04B 1/243 700/132 |
| 2016/0051009 | A1 * | 2/2016 | Kormann | B22F 10/20 36/103 |
| 2016/0069003 | A1 * | 3/2016 | Molnar | D03C 19/005 700/140 |
| 2018/0020761 | A1 * | 1/2018 | Cai | A43B 23/0245 36/48 |
| 2018/0135213 | A1 * | 5/2018 | Bell | A43B 23/0245 |
| 2019/0029369 | A1 * | 1/2019 | VanWagnen | D04H 3/005 |

* cited by examiner

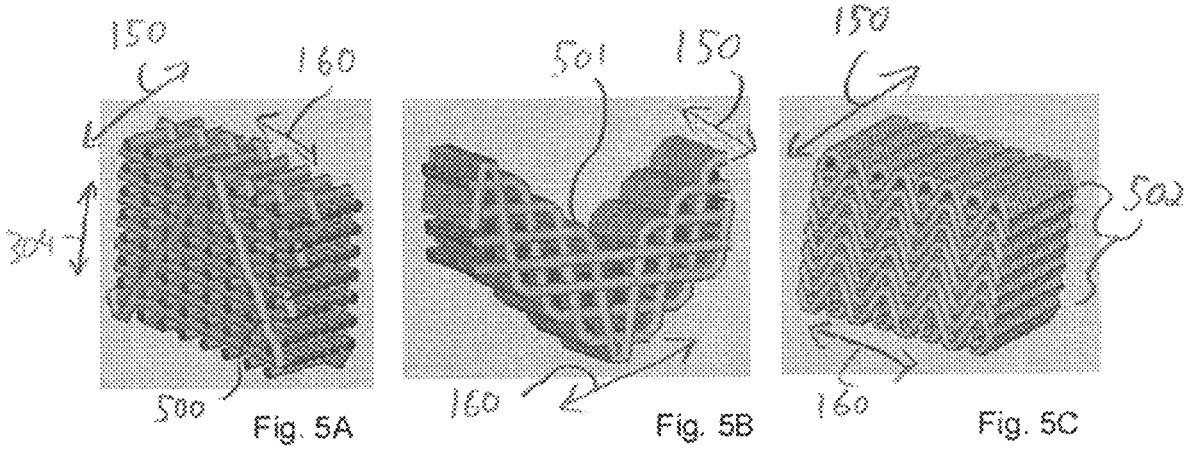
150
160
304
500
Fig. 5A
501
150
160
Fig. 5B
150
500
160
Fig. 5C
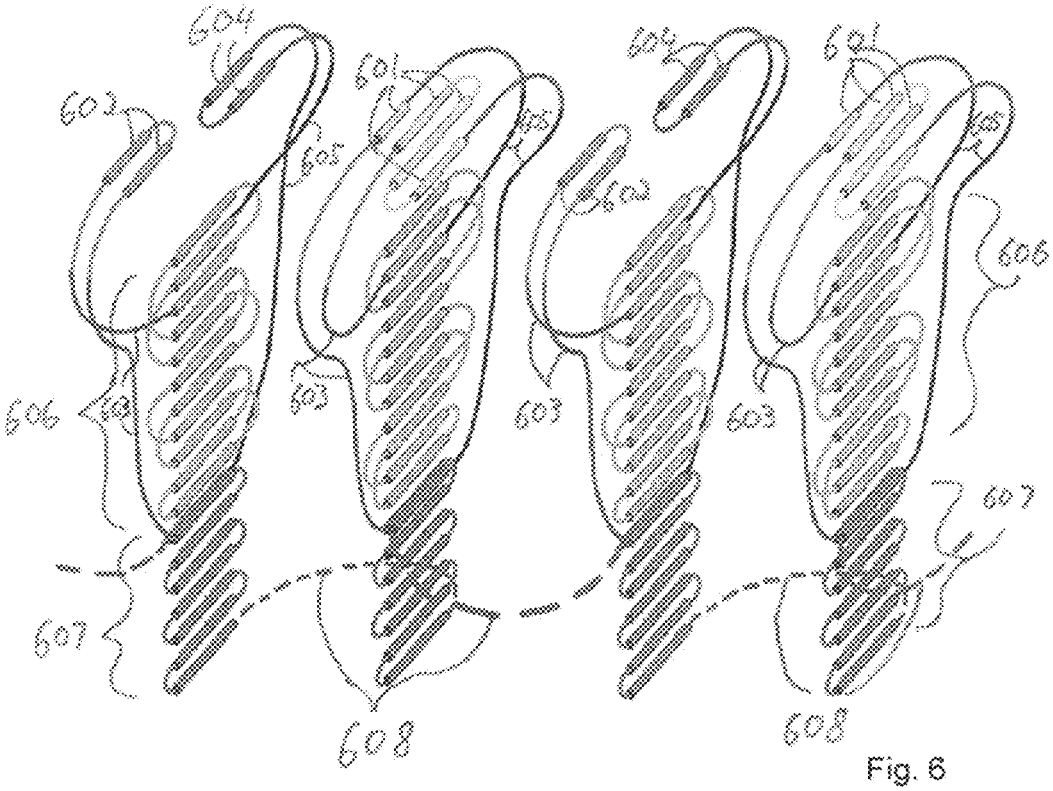
604
602
601
605
606
603
607
608
Fig. 6

FULLY-FORMED VOLUMETRICALLY WOVEN ARTICLE

RELATED APPLICATIONS

This application claims the benefit under 35 U.S.C. § 119(e) of U.S. Provisional Patent Application No. 62/879,380, filed Jul. 26, 2019, entitled "VOLUMETRICALLY WOVEN FULLY-FORMED SHOE," incorporated herein by reference in entirety.

BACKGROUND

Weaving is a traditionally manual process for forming textile goods such as clothing from spun fibers, often of a natural origin such as cotton, but also with synthetic fibers based on polymers as technology evolved. Industrial and technological advancements have improved and accelerated production of woven textiles, however the physical fibrous construction of warp and weft fibers interlacing to form a perpendicular arrangement of a flexible two dimensional sheet of textile material has remained. The resulting planar sheets are often formed into rolls of textile material for subsequent manufacturing through cutting and sewing the woven material into articles of clothing.

SUMMARY

A volumetric weaving approach introduces a vertical aspect to woven warp and weft fibers to generate volumetric structures through formation of tie-downs. Tie downs define warp and weft fibers that take a vertical path or vertical component extending perpendicular to a weave plane defined by a default orientation of the warp and weft fibers. Independently controlled heddles provide selective warp fiber control, and a two dimensional (2D) creel that dispenses the warp fibers at differing feed rates allows manipulation of the fibers into three dimensional (3D) structures or portions. The heddles that independently raise and lower each warp fiber are arranged in groups that define layers. As a shuttle draws the interlaced weft fiber, different layers are raised and lowered to lend a vertical, or z-axis to the resulting volumetric structure. Interconnections between the portions include the use of the tie downs to connect multiple portions to define 3D panels of a finished article such as a shoe. A single pass defining all the interconnected portions of the shoe generates the fully formed shoe without subsequent, or with minimal, cutting and seaming of different textile panels.

Configurations herein are based, in part, on the observation that woven textiles are often employed for personal apparel items and domestic items, including clothing, bedding, footwear, furniture upholstery, carpeting and vertical furnishing such as drapes. Unfortunately, conventional approaches to textile production suffer from the shortcoming that conventional woven articles require substantial manufacturing effort for transforming raw woven textiles into finished articles. Conventional rolls of planar material sheets are cut and sewn into a finished article based on a pattern of two-dimensional shapes that are sewn, seamed or glued together into a 3-dimensional shape suitable for use as apparel, furnishings, footwear, etc.

Conventional shoes, in particular, are labor intensive because the textile areas are rather small and substantial structure is added to a relatively small area of woven upper or sole area, therefore much of the production expense lies in the assembly, rather than the raw materials. Further, shoes often employ a sole or ground contact surface formed from a non-woven material such as rubber, leather or polymer material that is glued or fused to the shoe upper.

Accordingly, configurations herein substantially overcome the shortcomings of conventional manufactured shoes by providing a volumetrically woven article formed entirely of woven portions and interconnected junctures that define a complete shoe. Since the resulting pattern is executed to a near-finished product, cutting and sewing/seaming of woven patterns is avoided, as volumetric portions join using woven tie-downs to form junctures of the portions in 3 dimensions. Woven portions join to form angles that may be gently folded or raised to form the completed shoe. Excess fibers may be cut away to define a final footwear shape, but additional attachments or seams between portions are avoided. Sole surfaces that engage the ground may be defined by resilient or elastic fibers, but are nonetheless part of the overall woven approach; no gluing of non-woven sole material is needed. Alternative ground-interface sole materials may of course be added as coatings or layers to the finished woven article for accommodating particular end-use surfaces.

The disclosed woven article, defined by a shoe in the example configuration herein, merges concepts of a woven layer and a tie-down in a manner which allows the entire 3 dimensional article to be completed from a single run or feed of warp fibers, imposing only a minor finishing step of trimming excess warp and weft fibers to separate the article and free up portions defined as separate layers. In contrast, conventional approaches weave separate portions, or panels of the shoe, and seam or glue the individual cut seams to form the 3 dimensional article.

Layers are defined by groups of warp and weft fibers, distinguished by the heddles which raise them as a group. It should be apparent that a group defines warp fibers that will all be either raised or lowered for a given shuttle pass, and thus the corresponding weft fiber. Tie downs, as employed herein, link or join different layers, and hence provide communication between the layers by warp of weft fibers in each joined layer. In other words, fibers that are "members" of both groups. This may also impose a vertical transition to the fibers designated as tie downs, as discussed further below.

In further detail, an automated weaving apparatus is responsive to a file of weaving instructions, including commands for directing heddles of a plurality of warp fibers from a creel of fibers having independent delivery rates. The weaving instructions take the form of a design file that performs a method for single pass weaving of a footwear appliance, including drawing a plurality of warp fibers from a creel, and extending each fiber of the plurality of warp fibers through a respective heddle. The notion of a single pass refers to an iteration of shuttle passes across a common feed of warp fibers such that the entire article may be cut in a single transverse run across the parallel warp fibers. A single weft fiber, or multiple weft passes with different fibers may be employed in encirclement of the article. Each heddle is disposable (raised and lowered) in a vertical direction independently of the other heddles. The loom draws a shuttle across the plurality of warp fibers in a directions substantially perpendicular to the warp fibers.

The general orientation of the warp fibers defines a weave plane, as the shuttle draws a continuous weft fiber in each pass across the warp fibers. Successive passes generate a plurality of portions, such that each of the portions is based on a woven area of a finished 3 dimensional structure. The weaving instructions join each of the plurality of portions to at least one other of the plurality of portions by a tie-down, such that the tie downs are configured to join portions at a non-planar juncture. Generated portions result from accumulation of shuttle passes across drawn warp fibers based on the weaving instructions. Accumulation of the portions includes orienting warp fibers along a z-axis normal to the weave plane, and arranging the plurality of portions according to the non-planar junctures, in which each portion joins to one or more adjacent portions by the vertical tie-downs

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIGS. 5A-5C show 3 dimensional woven structures utilizing the Z axis normal to the weave plane;

FIG. 6 shows shuttle passage for constructing a tongue portion in the article of FIGS. 4A-4D;

DETAILED DESCRIPTION

Figure 1:
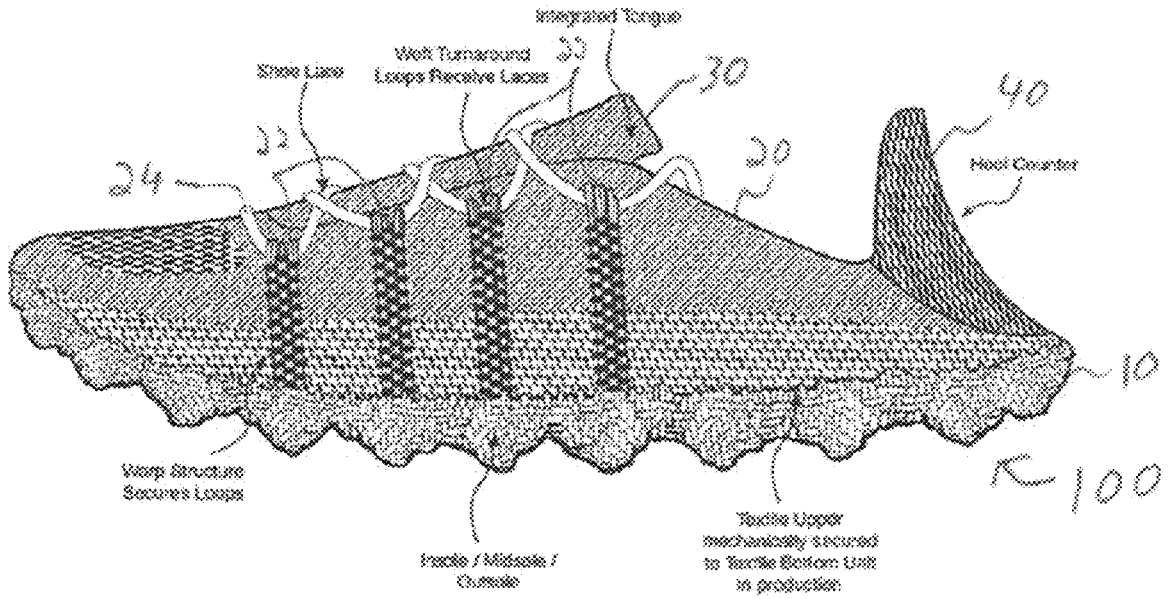
FIG. 1 is a side view of an example of a volumetrically woven shoe article according to the approach disclosed herein.

A woven article completed in a single woven pass streamlines the manufacturing process by avoiding subsequent cutting, sewing and seam attachments required by conventional approaches. An example article in the discussion below employs a shoe as an example, however other articles may be woven employing similar practices. The article is defined by planar 2D components that assemble along woven seams to create the volumetric shape of a shoe.

Woven articles conventionally require cut portions from a two dimensional textile surface to be sewn or attached via seams to manufacture a finished article such as clothing, footwear and outerwear. Conventional woven structures employ interlaced fibers intersecting in a perpendicular arrangement (warp and weft) to define a planar material adapted for rolling into sheets for subsequent cutting and seaming. Extensions to a simple, alternation of interleaved fibers include the Jacquard loom, which extends alternation of woven fibers to allow independent control of each warp fiber resulting in a visual pattern on the resulting planar textile. Jacquard looms have evolved to employ paper tape or punch cards to specify the warp fibers, and hence the pattern, to be woven. Several variations have emerged to implement the concept of individually addressable heddles for directing warp fibers, including punched tape, cards and perforated plates, somewhat similar to advancements in digital computer coding of instructions.

Modern industrial looms based on the Jacquard principles give rise to volumetric weaving, which allows manipulation of the warp and weft fibers to produce a "thicker" woven structure as complex weaving patterns tend to draw the fibers in a vertical direction. Weaving instructions including grouping of heddles and warp fiber control emanate from an edited file for easy modification, rather than physical paper or card mediums. Nonetheless, conventional woven structures remain a primarily two-dimensional medium.

In contrast, configurations herein employ volumetric approaches and Jacquard techniques to generate a 3-dimensional article defined by layered portions that utilize a z-axis extending out of (perpendicular to) the weave plane. The layered portions retain hinged or angled junctures or attachments to other woven portions such that the finished article may be deformed and/or folded along the junctures to define a 3D intersection of woven portions. Cutting and/or trimming of continuous warp fibers may be employed to liberate layered portions, but the portions remain attached to adjacent portions at the woven junctures to define the finished 3D article.

In configurations herein, a shoe provides an illustrative example of a fully-formed woven article due to the angled junctions of the portions and the use of specialized structures such as the tongue and eyelets (apertures) for laces. Volumetric weaving as defined herein streamlines the additive process of typical shoe construction.

Configurations herein employ tie downs in conjunction with the volumetric weaving approach. The use of tie downs effectively replaces steps such as seaming and gluing in conventional shoe production which can be vertically integrated in one process as well as one facility. This method of shoe manufacturing eliminates the chemical attachment of the upper and insole to the sole of a shoe and streamlines the process by removing the need for separate component parts, or portions of the shoe.

The shoe is comprised of warp and weft yarns that can be customized to achieve desired material qualities of different types of shoes. By utilizing a specialized setup for the Jacquard loom (discussed further in FIG. 3 below) and conceptualizing volumetric structures (shown in FIGS. 5A-5C below) as compilations of weave blocks, or weave units. The disclosed approach depicts a design methodology that more fully exploits this mechanism on all axes of the woven form. The weave blocks implement architectural portions of the full woven structures that exhibit particular 3-dimensional features. In implementation, weave blocks are continuous with adjacent weave blocks and are joined using the woven constructs defined herein.

The features of the shoe are executed using a weaving loom with a Jacquard mechanism and one or more shuttles. Volumetric weaving structures are utilized to create the full shoe article. It is understood that volumetric woven architectures can be designed that exhibit different "behavioral tendencies", such as the inclination to fold/unfold, build up as an arch, display rigidity and softness, and form various shapes and cavities. It is further understood that these factors encompass aspects such as the diameter, density and type of yarn used for both the warp and weft fibers.

FIG. 1 is a side view of an example of a volumetrically woven shoe article 100 (article) according to the approach disclosed herein. The article 100 has woven zones including a sole 10, an upper 20, a tongue 30 and heel 40. Eyelets 22 provide for laces 24, which of course accessorize the finished article 100. These and other portions are included in the fully formed shoe, discussed further below.

In the discussion below, the following terms are employed with reference to the loom and operation thereof:

Warp—yarns/fibers in the y axis, in this context, each end is individually tensioned on a creel set up, feeding fibers through an array of rolls of fiber stock;

Weft—yarns in the x axis, fill yarn, yarn that travels through the shuttle pathways;

Tie downs—fibers that connect layers in the weave, including warp yarns and weft yarns traveling through the depth of the volume to create z axis interlacings;

Linking yarn—a tie down forming an attachment or linkage to a discrete portion or region at a juncture or seam for joining layers and forming or providing a three dimensional partially detached woven region;

Shuttle pathways—the continuous path the weft yarn/fiber traverses perpendicular to the warp through the woven article, in this case the volumetric woven shoe;

Volumetric weaving—a textile manufacturing technique utilizing a loom which can be used to fabricate 3D shaped forms by conceptualizing woven volumes as aggregations of weave blocks Creel—a warping device allowing tensioning for individual warp ends, allows for warp ends to travel different lengths in order to create a volumetric form (as opposed to a conventional warp beam that needs to maintain equal tension across the entire width);

Jacquard mechanism—controls the raising and lowering of each individual warp fiber through loops in independently controllable heddles;

Layer—a group of warp fibers controlled by heddles that raise and lower together such that the warp and weft fibers in the layer define a discrete or atomic portion of woven material connected to other portions by tie downs;

Selvedges—left and right edges of a woven piece of fabric;

Woven eyelet—weft yarn that utilizes shuttle turnarounds and floats to create stable loops for a shoelace as a tightening method for the wearer;

Crenelated sole—a woven zone on the bottom plane of the shoe that inclines and declines with the movement of yarns on top of one other;

Paused shed—process that allows building up height/depth of specific sections within the woven product. It utilizes allocated warp ends in a way that external layers are not tied together during the build-up process;

Weave block—A spatially organized array of stacked yarns that allows for the visualization of specific woven interlacings;

Safe selvedges—A selvedge, placed on an outer edge or an internal edge created along any patterned fabric edge at any depth within the shoe with an engineered structure that will remain secure and not unravel after excess warp or weft edges are cut away.

Figure 2:
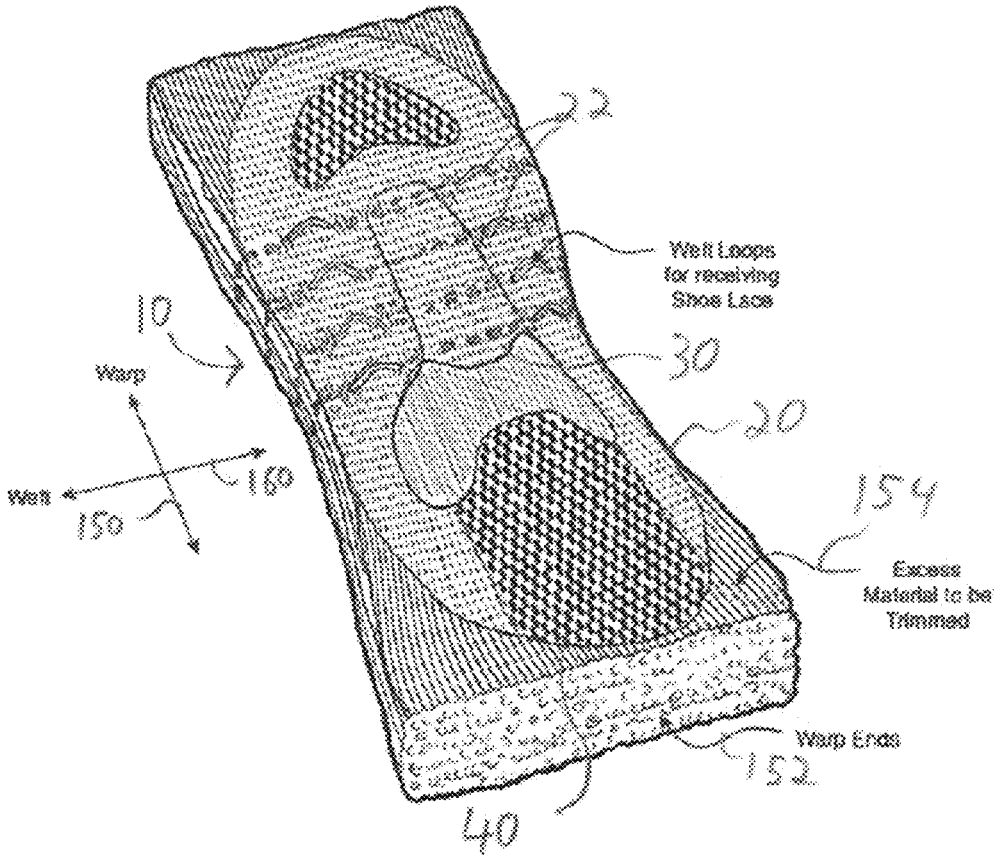
FIG. 2 is a perspective view of the article of FIG. 1 emerging from a loom.

Fiber—warp or weft yarn or textile/polymer strands fed from either the creel (warp) or shuttle (weft) and volumetrically interlaced by the loom to form the finished article FIG. 2 is a perspective view of the article of FIG. 1 emerging from a loom. Referring to FIGS. 1 and 2, the warp 150 fibers feed the longitudinal orientation of the article 100 and the weft 160 fibers are generally transverse or perpendicular along the narrower width dimension. Warp ends 152 are cut between each formed article, as the warp fibers run continuously for multiple articles. Excess fibers 154 may be trimmed, again because the warp fibers run continuously inter-article, but no external joins or seams are needed. Eyelets 22 resulting from formed weft loops may be used for lacing, discussed further below.

Conventional shoes undergo an extensive assembly process after the textile regions that define different shoe panels are completed. Current shoe manufacturing processes require an assembly of the different components that make up a shoe. This generally involves chemically attaching an upper to a bottom unit. The upper part of the shoe usually consists of two major elements: the upper and insole which is created by wrapping ("lasting") an upper around the bottom perimeter surface of an insole, securing and bonding it to a bottom unit (a midsole and or outsole). The upper is usually created using cut-and-sew methods and/or through automated knitting processes.

In contrast to the articles 100 of FIGS. 1 and 2, manufacturing of conventional shoes is a multi-step process with many different operations that utilize various types of machinery, chemicals and human labor. The separate operations of the extensive assembly process generate significant material waste. Further, chemical adhesives and the transportation of component parts creates a substantial carbon footprint.

Figure 3:
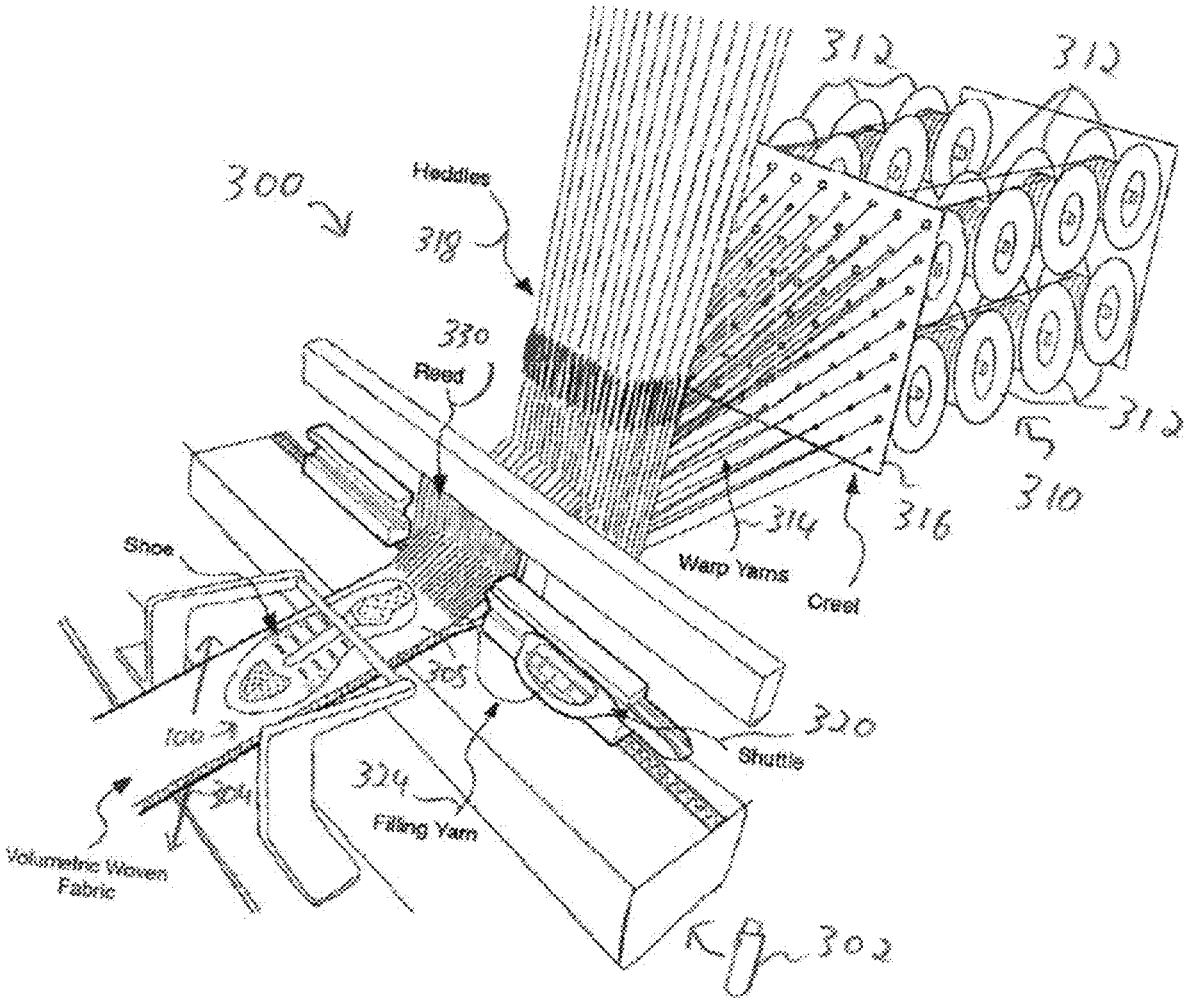
FIG. 3 is a loom apparatus suitable for use with configurations herein.

FIG. 3 is a loom apparatus suitable for use with configurations herein. Referring to FIGS. 1-3, a modern industrial loom 300 includes extensions to a traditional loom. A creel 310 includes individual rolls 312 of warp fibers 314, or warp. An array 316 arranges the warp fibers 314 horizontally and vertically prior to directing the warp fibers 314 to corresponding heddles 318. A Jacquard mechanism activates the heddles individually, allowing each warp fiber 314 to be raised or lowered independently, in contrast to conventional harnesses or frames which raise a group of warp yarns together. A shuttle 320 draws a weft fiber 324, or filling yarn, across the warp fibers 314, running under raised fibers and over unraised/lowered fibers in each pass, thereby defining the interlacing of the weave. A reed 330 compresses or tightens the weft fiber 324 after each transverse pass, resulting in the woven article 100 based on an instruction file or graphic file 302 which directs the heddles 318, creel feed and shuttle 320. The graphic file 302 operates somewhat similar to a to a 3D printer document, however the sequential nature of the weave fibers are not pixel addressable, therefore approaches such as disclosed and claimed herein direct the loom accordingly through the graphic file.

The resulting volumetric weaving sequence directed by the instruction file generates the article 100. The instruction file directs the loom 300 to generate the shoe in a single woven pass using volumetric techniques. Volumetric weaving conceptualizes woven volumes as compositions of weave blocks. The use of weave blocks enables the design of the volumetric form to occur in three distinct facets.

1). Woven architectures may be developed to suit the material demands of different zones in the final product.

2). Planning of the shuttle passageways dictates the arrangement and connection conditions between different layers of architectures.

3). Design of the Jacquard graphic allows for fine-tuning the placement of prepared architectures, defining the overall shape of the volumetric form.

Traditional weaving interlaces warps and wefts in a horizontal direction to create common fabrics, such as denim, upholstery fabrics, bedding, etc. Volumetric weaving is a textile manufacturing method that modifies traditional weaving techniques to create thick fabrics made of multiple layers woven together and connected through the use of "tie downs", or specified fibers that link layers together. A related technique may be applied in the composites industry to create thick billets or woven forms for shaping through resin infusion.

Volumetric weaving allows direction of the loom for weaving the 3D structures and junctures for several reasons:

(1) the use of z-axis yarns (tie downs) that link layers;

(2) specialized warp creel and material setup;

(3) a "paused-shed" technique for building volumetric regions;

(4) customized shuttle passage to define cavities and physical extensions;

(5) 2D architecture that unfolds to 3D form;

(6) sequential construction from top to bottom, front to back; and (7) minimal post-production forming and finishing.

The Jacquard mechanism is utilized to translate graphic files into 2D fabrics by encoding the interlacing of warp and weft yarn as a binary file—called a "card image" which is then input to the loom. While Jacquard weaving has evolved since its inception over two centuries ago, becoming faster and more precise, the card image has remained generally focused on 2D patterns.

Modern looms extend the Jacquard approach using the instructions in the graphic file for implementing volumetric weaving, in which yarns/fibers not only move horizontally and vertically but also along the depth axis throughout the volume of the textile. However, the complexity of the card image used in volumetric weaving has inhibited the design of complex volumetric textiles.

A specialized setup for the loom is comprised of three main parts. First, the Jacquard mechanism itself is connected to the loom using a narrow but deep harness tie, or array of spring-loaded strings linking the Jacquard hooks to the heddles in the loom. This is also called the "castout". The setup of the castout reflects the anticipated number of layers in the fabric; for example, a fabric with fifteen layers would require a castout that is at least fifteen harnesses deep, such that each harness represents a controllable layer of the final fabric.

Second, the loom utilizes a creel rather than a standard warp beam unrolling in a single plane. The creel defines an array of individual warp yarns that can accommodate variation in the quantity of yarn used, also known as the "take up." Third, the specialized loom utilizes one or more shuttles to insert weft yarn, as alternatives to rapier insertion, airjet, or other methodologies. This allows the continuous yarn passage(s) to be guided and reversed throughout the horizontal width of the fabric.

FIGS. 4A-4D are views of portions of a volumetrically woven article as in FIGS. 1 and 2 in conjunction with the apparatus of FIG. 3. Referring to FIGS. 4A-4D, the example woven article (shoe) 100 includes a plurality of portions. The example shoe portions include a sole 102, toe 104, heel 112, tongue 110, bottom right upper 106, bottom left upper 116, top right upper 108, and top left upper 118. Various other portions and arrangements may be defined for other woven articles.

In contrast to conventional cut-and-sewn panels, the portions join by woven junctures which define or allow the portions to join and/or deform at angles and thus form the 3D article 100. The junctures define warp and weft fibers running between the portions that attach the portions at different angles, effectively replacing a conventional cut and seam. In other words, rather than cutting the two dimensional shapes corresponding to portions, multiple portions are woven in the same pass or run, and the warp and weft fibers manipulated through the instructions in the graphic file 302 to form the junctures between portions, rather connections being made post-weave by additional sewing with another fiber or solvent/adhesive approaches. For example, a tongue juncture 111, operates as a hinge and allows the tongue 110 to pivot or "flap" for shoe entry and exit, discussed further below in FIG. 8.

In a basic configuration, each of the portions may be defined as a layer of woven material, linked by tie downs to form junctions with adjacent portions. In contrast to conventional approaches, the disclosed linking yarns define a fiber or tie down forming a junction or attachment between layers. The layers and linking yarns form the completed article woven from a single run or length of warp fibers without additional seaming, sewing or attachment for joining layers after removal from the loom. Cutting and trimming may be performed to address excess fibers and liberate certain edges of the portions, but no additional attachment or seams are needed.

The tie downs link layers using one or more warp or weft yarns and can extend in varied arrays through one or more layers, and may form a "cascading" of material in the warp or weft direction, hence in the x,y plane defined by the loom fibers. The tie-downs generally connect layers defined by groups of warp and weft fibers, and as applied to the portions of FIGS. 4A-4D, may connect each of the portions to an adjacent portions, where the portions are each formed as layers. In the claimed approach, linking yarns are employed at the junction, or edge of each portion shown by the dotted lines to allow the tie down joined portions to "unfold" into the shoe article upon removal from the loom.

Continuing to refer to FIGS. 4A-4D, and also to FIG. 3, the automated weaving apparatus (loom) 300 is responsive to a file 302 of weaving instructions. The file includes commands for directing the heddles 318 of a plurality of warp fibers 314 from a creel 310 of fibers having independent delivery rates. The file 302 directs a method for single pass weaving of a footwear appliance or article 100, including drawing a plurality of the warp fibers 314 from the creel 310, and extending each fiber of the plurality of warp fibers through a respective heddle of a plurality of heddles 318. Each heddle is disposable in a vertical direction independently of the other heddles in the plurality of heddles for elevating the warp fiber extending therethrough.

The loom 300 draws the shuttle 320 across the plurality of warp fibers 314 in directions substantially perpendicular to the warp fibers. The warp fibers 314 generally define a weave plane 305, such that the shuttle draws a continuous weft fiber 324 in a pass across the warp fibers 314. Depending on the configuration, looms may use multiple shuttles and/or change warp fibers, but each shuttle continues to draw the respective fiber transverse across the same continuous warp fibers 314 according to the raised/lowered position of the heddles 318. Each warp fiber is controlled (raised/lowered) by a respective heddle, and may be arranged into groups with other warp fibers to raise/lower as a group. Each group of heddles may define a layer including a subset of the warp fibers based on the warp fibers controlled by the respective heddle, such that the heddles in the group are controlled together as a unit whereby the shuttle passes either above or below all the warp fibers in the group.

Figure 4A:
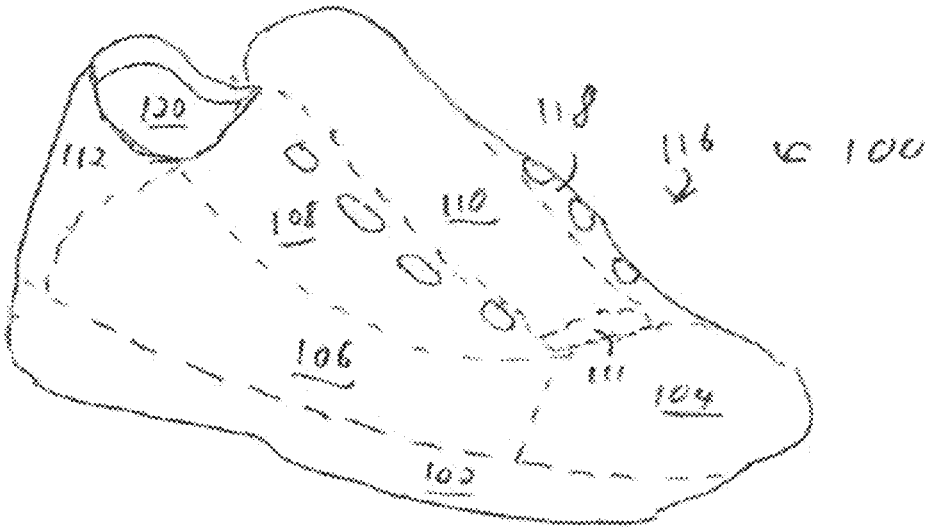
FIGS. 4A-4D are views of portions of a volumetrically woven article as in FIGS. 1 and 2 in conjunction with the apparatus of FIG. 3.

The shuttle action and corresponding warp fiber advancement generates a plurality of the portions, such that each of the portions is based on a woven area of a finished 3 dimensional structure as shown in FIG. 4A. In the example shown, the plurality of portions define a shoe structure adapted to envelop a human extremity.

Over the course of loom operation, the article 100 accumulates the generated portions from accumulation of shuttle passes across drawn warp fibers 314 based on the weaving instructions in the file 302, such that accumulation of the portions includes orienting warp fibers along a z-axis 304 normal to the weave plane 305. The weave joins each of the plurality of portions to at least one other of the plurality of portions by a tie down configured to join portions at a non-planar juncture, meaning that the juncture forms an angular or deformable attachment to the adjacent portion. The completed weave run or pass thus arranges the plurality of portions according to the non-planar junctions, such that each portion joins to one or more adjacent portions by the vertical tie downs.

In the claimed approach, the tie downs may define a linking yarn structure defined by warps or wefts that connect different the different portions or zones of material together by making a brief or a more sustained diversion into or around a neighboring portion or zone. Such a linking yarn contrasts with a traditional weaving tie-down that "stitches" layers together via a single point of layer switching or a longer linear seam of connection between two discrete layers, or a solid block of material in which every yarn can be characterized as an "layering" interconnection. A linking yarn can also be created through a continuous selvedge behavior of a weft yarn in which a yarn changes direction during the weaving process in order to define a boundary of a single layer, to link to layers together, or to create a linked exterior shell on the surface of a solid block area.

To further distinguish the claimed usage of tie downs as linking yarns, layers that are strictly defined within one portion or zone of the article can be reallocated in an adjacent area of structure. In general, control of individual heddles (and corresponding fibers) in three dimensions means that yarns can be designated into multiple roles or position within the depth of the fabric, for example as a member of one or more layers and also as a tie down/linking yarn at different positions along the run of warp fibers. Any fiber may define a linking yarn for a time, based on the heddle and layer control. Such a run of fibers refers to a single feed or parallel warp fibers fed concurrently from a creel and terminated at the start and finish of the article, being a toe (start) and heel (finish) in the example approach.

Figure 4B:
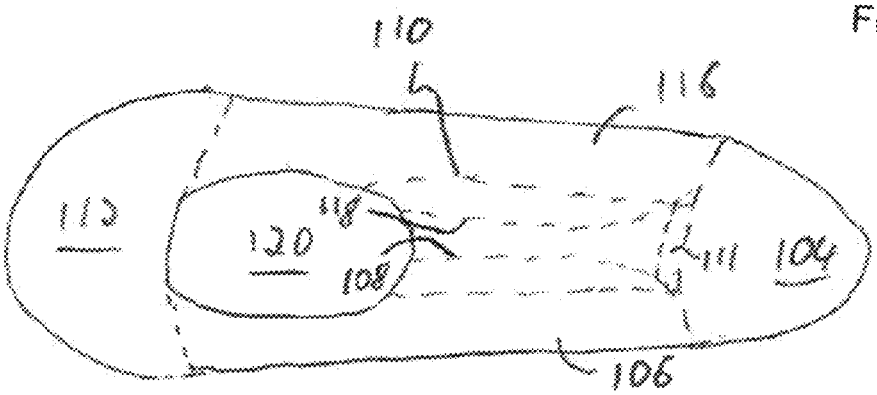

In operation of the loom 300, each of portions defining the shoe structure are joined to at least one other of the plurality of portions by at least one of warp fibers, weft fibers or tie downs. FIG. 4B shows a top or plan view of the woven shoe. Woven structures include an opening or void 120, for foot entry, and the tongue 110, which may form a layer extending over the right and left lower upper 106, 116, shown in a side view in FIG. 4C and a front view in FIG. 4D.

Figure 4C:
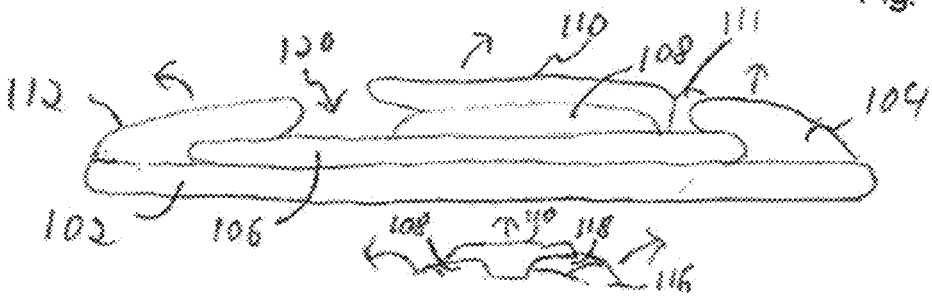
Figure 4D:
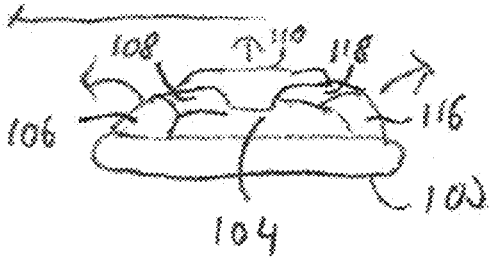

FIG. 4C shows a side view of the article 100 depicting the layered structure, and FIG. 4D shows a front view looking in a direction from toe to heel. Manipulation of the heddles, and corresponding groups of fibers, causes certain warp fibers to interlock with shuttle drawn weft fibers above other warp fibers and form layers. The resulting layers form the toe 104; the sole 102 underlies the toe, lower right and left lower upper 106, 116, and heel 112. The top left and right upper 108, 118 are adjacent the tongue juncture 111, and the tongue 110 defines the top layer. Upon completion and cutting of excess warp fiber, the heel 112 folds or deforms rearward, the tie 104 upward, and the right and left uppers 106, 116, 108, 118 fold out. The tongue 110 hinges upwards and out along juncture 111.

FIGS. 5A-5C show 3 dimensional woven structures utilizing the Z axis normal to the weave plane. Each of FIGS. 5A-5C depicts a weave block defined by fibers running according to a vertical component defined by a z-axis 304 extending perpendicular to the weave plane 305.

Weave blocks are an underlying conceptual approach for addressing the design of different areas of a volumetric form. Rather than focusing exclusively on the 2D layers of the cloth or the passage of the weft yarn, various protrusions or topographies of the design can be considered in smaller block-like component architectures that can be stacked or linked to other block-like component parts. In aggregate, this makes the consideration of complex form more simplistic and sequential. Each portion may include one or more weave blocks.

Although the tie downs are formed from the same warp and weft fibers that define the woven portions, their significance is in joining or "traveling" between layers, as defined by groups of warp and weft fibers controlled (raised and lowered) by a set of heddles designating the group. As modern looms allow independent addressing (raising/lowering) of individual heddles, the groups defining the layers may include any number of subset of fibers, and each fiber may be a member of multiple groups. Tie downs are therefore defined by warp and weft fibers that form an interconnection between groups. Such fibers may be considers "members" of both groups, or may be designated by a particular heddle that directs a fiber or fibers to interlock or engage both groups of fibers that define the layers to be joined/attached. In an example configuration, each portion (FIGS. 4A-4D) may be defined as a layer and tie downs designated at each seam or junction, shown by the dotted lines. Stated differently, to the extent that the layers impose a volume, or vertical component to the woven article (extending perpendicular to the x, y plane defined by the warp), tie downs may take on a vertical component in linking the layers, however this is not required.

Continuing to refer to FIG. 3, and also to FIGS. 5A-5C, the warp fibers 314 are defined by fibers emanating from the creel 310 drawn in a direction defined by the longitudinal direction of the shoe structure, i.e. toe to heel. Alternative approaches may employ the warp fibers across the width draws in a "left to right" manner. The weft fibers 324 are defined by the shuttle drawn fibers perpendicular to the warp fibers 314 on the weaving plane 305, and tie downs defined by warp fibers and weft fibers having a vertical component in a z-axis 304 based on movement of the heddles 318. Rather than conventional weaving which orients fibers only in the horizontal weave plane, raising different heddles allows the weft to orient partially along the z-axis in an upwards direction, as more warp fibers are lowered as the shuttle passes to provide "lift" or inject volume. The weft fibers 324 may follow an inverted "V" 500 (FIG. 5A), or a sharp dip 501 as a juncture or bend is imparted to the block, in FIG. 5B. A vertical accumulation of warp fibers 502 adds a "thickness" to the weave block in FIG. 5C. The vertical component to fiber orientation derives from manipulation of the heddles. Each heddle controls a corresponding warp fiber passing through an eye in the heddle, and each heddle is operable for a raised position or a lowered position during each pass of the shuttle. Heddles may be arranged in any manner for residing and lowering warp fibers as a group. The raised groups may define layers of the article since the group is raised or lowered together. These positions define whether the weft passes above or below the controlled warp fiber during the respective pass. A plurality of defined tie downs, in which each tie down extends between a plurality of layers, accumulates fibers in in the z-axis direction, as each tie down has a component along an axis normal to the plane defined by the warp fibers.

FIG. 6 shows shuttle passage for constructing a tongue portion in the article of FIGS. 4A-4D. Referring to FIGS. 4A-6, the shoe portions are executed in separate areas within the assembled weave architecture, and warp ends designated for use in the separate layers (sole material, insole material, upper material, etc.) are made to interlace with wefts designated to form specific layers. In FIG. 6, the arrangement of fibers and portions include the tongue area 601, left upper top 602, left upper bottom 603, right upper top 604, right upper bottom 605, insole (bracketed region) 606, sole (bracketed region) 607, and connecting wefts (dotted line) 608.

As the heddles 318 define groups of warp fibers, the shuttle 320 makes a traversal pass when a group is raised to define a structure for that group to form a particular layer. Each heddle has an elevated position and a rest position such that each warp fiber 314 corresponding to the heddles in a particular group share the same of a rest position and an elevated position at any time. In other words, the group is raised and lowered together. The tie downs define a weft fiber extending to another layer resulting in the defined weft fiber attaining a vertical component. This occurs by selectively lowering or raising heddles out of their resting or lifted group position in order to link layers. While conventional weaving leaves weft fibers alternating above or below alternating warp fibers to result in a substantially two dimensional surface, the array of fibers emanating from the creel along with an ability to manipulate heddles for independent fibers lets the weft fibers take on a vertical orientation as multiple warp fibers accumulate in a "stacked" orientation.

Figure 7:
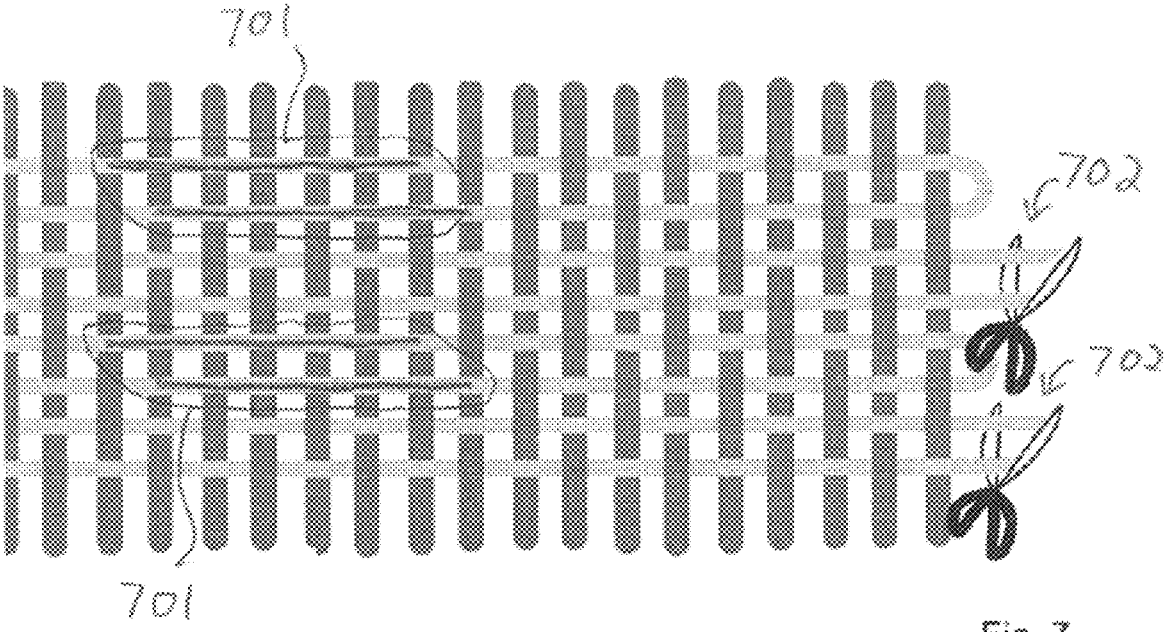
FIG. 7 shows eyelet construction adjacent a safe selvedge for the tongue portion.

FIG. 7 shows eyelet construction adjacent a safe selvedge for the tongue portion. In FIG. 7, woven eyelets are developed through the utilization of float regions 701 developed in the weave structure. The float regions 701 run continuously above a number of warp fibers 314 to accumulate a free length that a lace may be drawn through. When woven eyelets occur near a safe selvedge 702, the floating weft is placed intentionally to occur on a weft engaging on a turnaround at the selvedge. This ensures that the woven eyelet will remain secure when laces are pulled.

Figure 8:
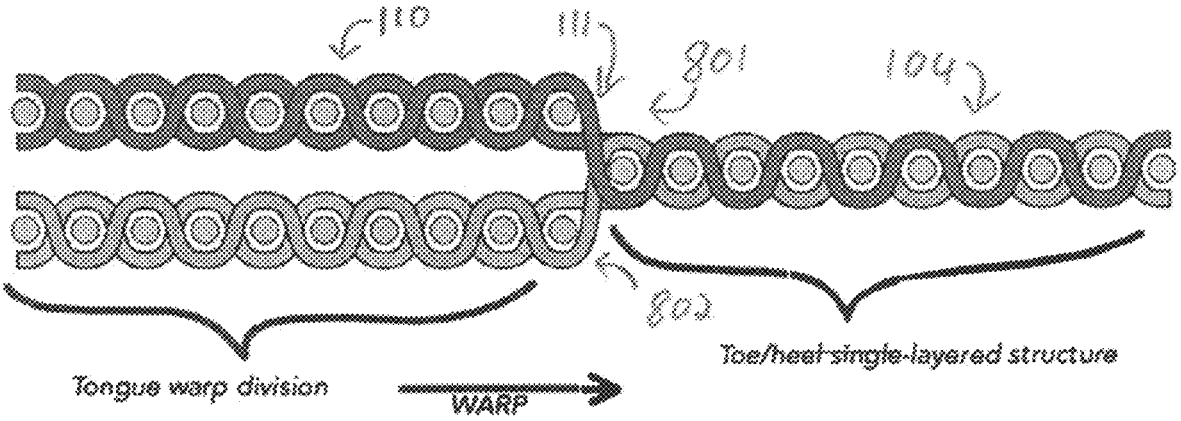
FIG. 8 shows warp division for the tongue structure as of FIGS. 6 and 7.

FIG. 8 shows warp division for the tongue structure as of FIGS. 6 and 7. As mentioned above, the tongue is a specialized structure as it is both hinged at a juncture 111 and layered under the right and left upper portions 108, 118. The tongue 110 and eyelets employ particular fiber patterns to guard against unraveling and create a secure edge. In the case of a reinforced selvedge that travels a diagonal line according to the graphic file 302, warps which weave on the top layer 801 of two layers of fabric 801, 802 may be used on the bottom of the securing structure and vice versa, with additional interlocking action added to further stabilize the edge.

In the case of the tongue 110, therefore, where a juncture 111 occurs to define layering and a diverging portion, accumulation of the portions defining the shoe structure result from a single weaving pass including the plurality of creel fibers and shuttle passes. The shuttle draws an individual, continuous weft fiber 324 across the warp fibers 314 during generation of each of the joined portions defining the shoe structure. The portion generation/accumulation occurs with all portions; FIG. 8 depicts an example with the tongue 110.

The shuttle passage is programmed within the different areas to define each shoe portion. For the tongue 110, for example, a selvedge is created by subdividing warp material that may have earlier or later been employed to weave the toe and/or heel of the shoe into a discrete layer, and shuttle turnarounds programmed to occur at either edge of the tongue warp section.

Figure 9:
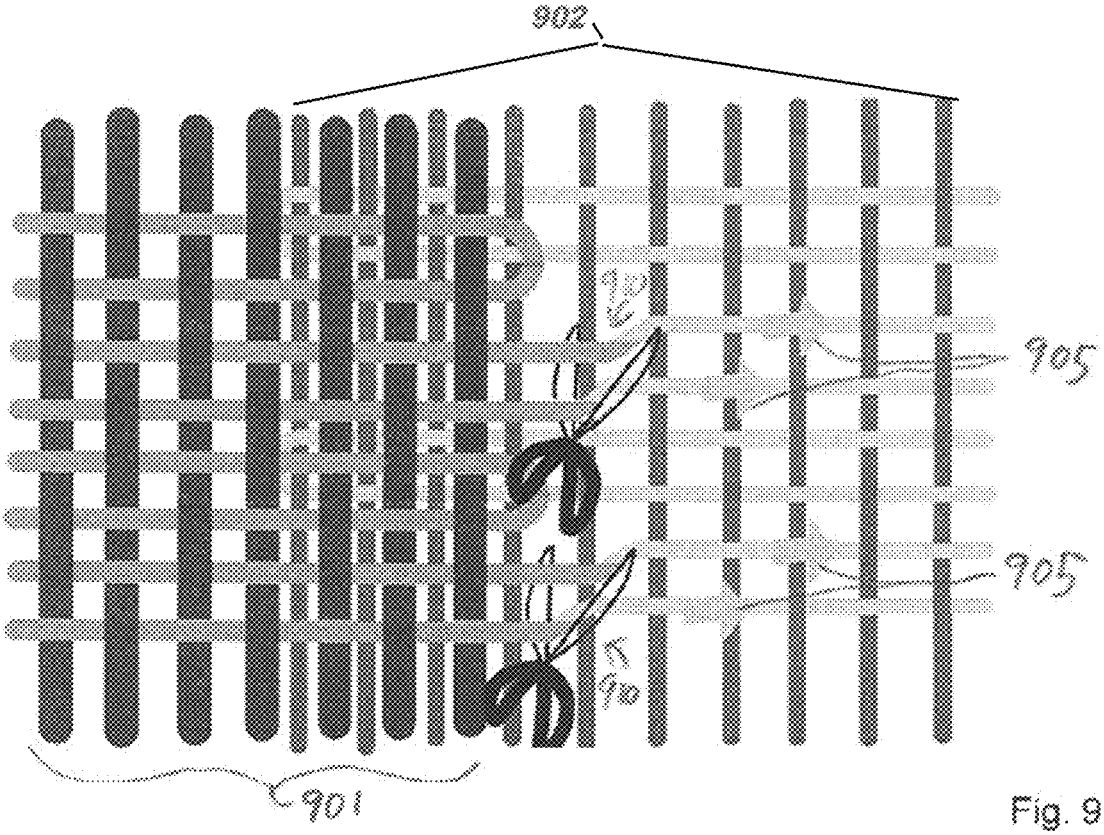
FIG. 9 shows a safe selvedge to promote integrity of the tongue portion.
Figure 10:
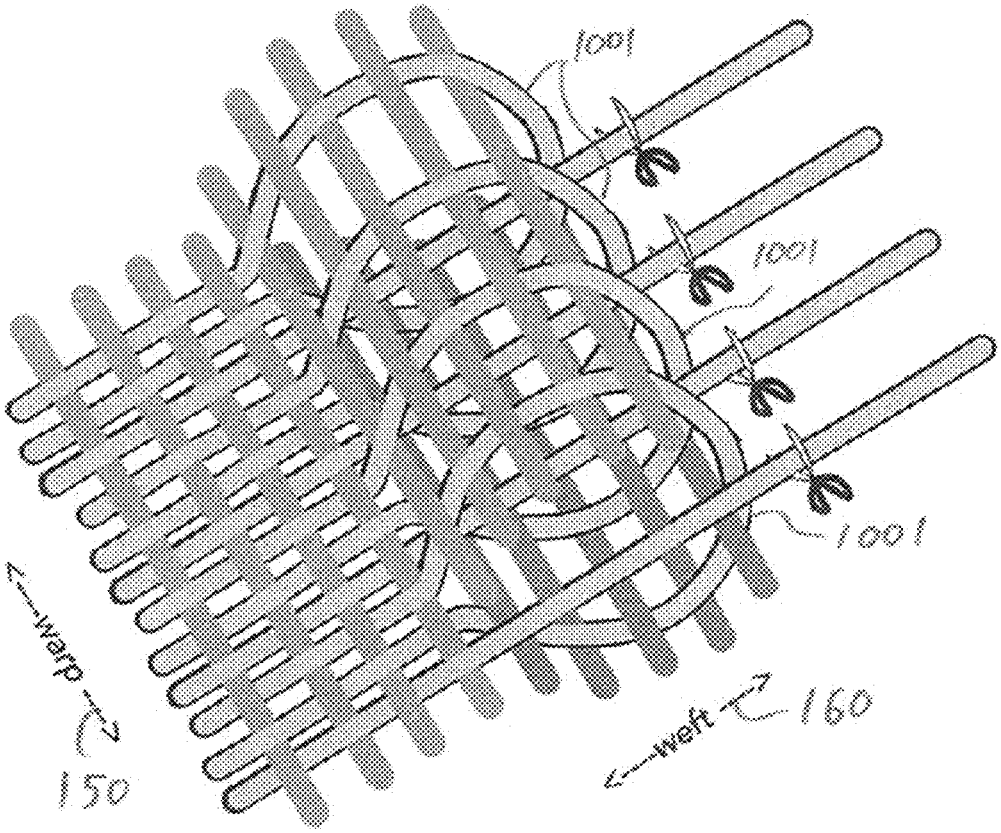
FIG. 10 shows shuttle passage for drawing the weft for a safe selvedge.

FIG. 9 shows a safe selvedge to promote integrity of the tongue portion. Safe selvedges are also programmed to occur at the left and right sides of the shoe upper local to the left and right edge of the tongue 110. A woven upper with a safe selvedge 901 is adjacent to the tongue 110 with a safe selvedge 902. Arrows 905 show cut weft entry into non-crucial locations, defined by cuts at locations 910. In the case of a single shuttle, entry and exit points for discrete sections of the shoe upper (tongue, heel tab) can be directed away from the selvedge to secure the far edges, placing the cut weft yarn into a structural position within the weave architecture that is non-essential to the structural integrity of the fabric FIG. 10 shows shuttle passage for drawing the weft for a safe selvedge. An effective safe selvedge can also be achieved by coordinating weft turnarounds 1001 that create an enclosing fabric layer around spanning wefts that are intended to be cut away.

Figure 11:
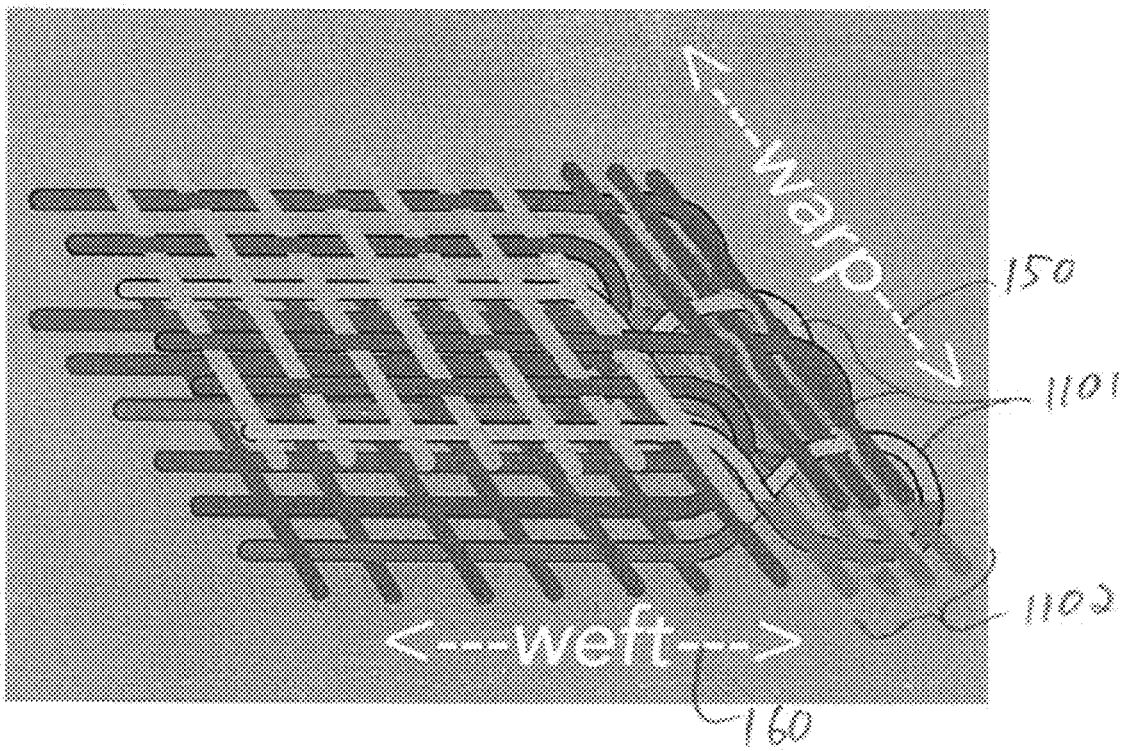
FIG. 11 shows a further example of a stabilizing edge to prevent unravelling of woven structures.

FIG. 11 shows a further example of a stabilizing edge to prevent unravelling of woven structures. Stabilizing selvedges are created using stabilizing weft passageways 1101 with interlaced warp ends at the woven seamed connections between layers of the shoe upper to provide secure boundaries for the shaping of the upper, including heel and toe edges. Stabilizing structures 1102 can be created at an edge to connect two separate layers of woven material by utilizing wefts 160 and warps 150 that shift positions along the z-axis 304.

Figure 12A:
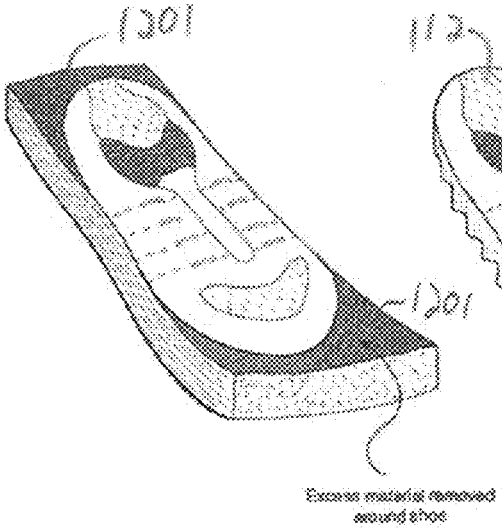
FIGS. 12A-12C shows post processing of the single pass woven article of FIGS. 1-11.
Figure 12B:
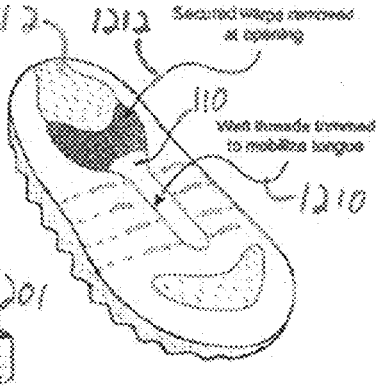
Figure 12C:
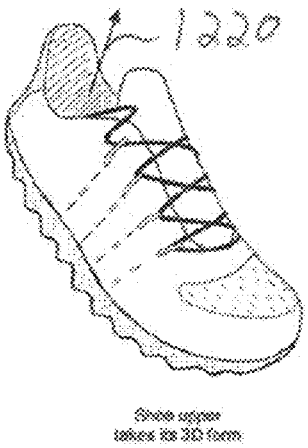

FIGS. 12A-12C shows post processing of the single pass woven article of FIGS. 1-11. Due to the stranded nature of the woven medium, in contrast to pixel addressable mediums such as 3D extrusion printers, warp fibers may remain unused and/or terminated. The warp fibers 314 across the weave plane 305 are severed for separating each 3 dimensional article. This may include selectively severing warp and weft fibers between the portions for forming the non-planar junctions based on a shape of the human extremity. In FIG. 12A, perimeter material 1201 separating successive article 100 runs may be trimmed. FIG. 12B shows severing portions 1210 between the tongue 110 and uppers 108, 118. Similar cutting may occur to liberate the heel 112 from warp fibers 1212 extending from the forward shoe. In FIG. 12C, the liberated tongue 110, heel 112 and uppers portions 106, 108, 116, 118 are slightly deformed and folded upwards as per the woven junctures to create a cavity for the wearer's foot.

Those skilled in the art should readily appreciate that the programs and methods defined herein are deliverable to a user processing and rendering device in many forms, including but not limited to a) information permanently stored on non-writeable storage media such as ROM devices, b) information alterably stored on writeable non-transitory storage media such as floppy disks, magnetic tapes, CDs, RAM devices, and other magnetic and optical media, or c) information conveyed to a computer through communication media, as in an electronic network such as the Internet or telephone modem lines. The operations and methods may be implemented in a software executable object or as a set of encoded instructions for execution by a processor responsive to the instructions. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. In an automated weaving apparatus responsive to a file of weaving instructions, the file of weaving instructions including commands for directing heddles of a plurality of warp fibers from a creel of fibers having independent delivery rates, a method for single pass weaving of a footwear appliance, comprising:

drawing a plurality of warp fibers from a creel;

extending each fiber of the plurality of warp fibers through a respective heddle of a plurality of heddles, each heddle disposable in a vertical direction independently of the other heddles in the plurality of heddles for elevating the warp fiber extending therethrough;

drawing a shuttle across the plurality of warp fibers in a direction substantially perpendicular to the warp fibers, the warp fibers defining a weave plane, the shuttle drawing a continuous weft fiber in a pass across the warp fibers;

arranging the heddles into groups, each group of heddles defining a layer including a subset of the warp fibers based on the warp fibers controlled by the respective heddle, the heddles in the group being controlled together as a unit such that shuttle passes either above or below all the warp fibers in in the group;

generating a plurality of portions based on the groups, each of the portions based on a woven area of a finished 3 dimensional structure;

joining each of the plurality of portions to at least one other of the plurality of portions by a respective linking yarn, the linking yarn configured to join portions at a non-planar juncture, the portions including a tongue;

accumulating the generated portions from accumulation of shuttle passes across drawn warp fibers based on the weaving instructions, accumulation of the portions including orienting warp fibers along a z-axis normal to the weave plane; and arranging the plurality of portions according to the non-planar junctures, each portion joined to one or more adjacent portions by the linking yarns, including forming the tongue as a top layer adjacent a right upper and a left upper based on a hinged juncture from a toe portion.

2. The method of claim 1 wherein the plurality of portions define a shoe structure adapted to envelop a human extremity.

3. The method of claim 2 wherein the portions include sole, toe, heel, tongue, bottom right upper, bottom left upper, top right upper, top left upper.

4. The method of claim 2 wherein each of portions defining the shoe structure are joined to at least one other of the plurality of portions by at least one of warp fibers, weft fibers or linking yarns.

5. The method of claim 4 wherein the warp fibers are defined by fibers emanating from the creel drawn in a direction defined by the longitudinal direction of the shoe structure, the weft fibers defined by shuttle drawn fibers perpendicular to the warp fibers on the weaving plane, and linking yarns defined by warp fibers and weft fibers having a vertical component based on movement of the heddles.

6. The method of claim 5 wherein each heddle controls a corresponding warp fiber passing through an eye in the heddle, each heddle operable for a raised position or a lowered position during each pass of the shuttle, the position defining whether the weft passes above or below the controlled warp fiber during the respective pass.

7. The method of claim 1 further comprising defining a plurality of the linking yarns, each linking yarn extending on an axis normal to a warp plane and between a plurality of layers, the linking yarn having a component along an axis normal to the plane defined by the warp fibers.

8. The method of claim 1 wherein each heddle has an elevated position and a rest position such that each warp fiber corresponding to the heddles in a particular group share the same of a rest position and an elevated position at any time, and the linking yarns define a weft fiber extending to another layer resulting in the defined weft fiber attaining a vertical component.

9. The method of claim 1 wherein accumulation of the portions defining the shoe structure results from a single weaving pass including the plurality of creel fibers and shuttle passes.

10. The method of claim 9 wherein the shuttle draws an individual, continuous weft fiber across the warp fibers during generation of each of the joined portions defining the shoe structure.

11. The method of claim 2 further comprising selectively severing warp and weft fibers between the portions for forming the non-planar junctions based on a shape of the human extremity.

12. The method of claim 11 wherein the plurality of warp fibers drawn from the creel extend through a plurality of the finished 3 dimensional structures; and severing the warp fibers across the weave plane for separating each 3 dimensional structure.

13. A computer program embodying program code on a non-transitory medium that, when executed by a processor, performs steps for implementing a method of implementing, on an automated weaving apparatus responsive to a file of weaving instructions, the file of weaving instructions including commands for directing heddles of a plurality of warp fibers from a creel of fibers having independent delivery rates, a method for single pass weaving of a footwear appliance, the method comprising:

drawing a plurality of warp fibers from a creel;

extending each fiber of the plurality of warp fibers through a respective heddle of a plurality of heddles, each heddle disposable in a vertical direction independently of the other heddles in the plurality of heddles for elevating the warp fiber extending therethrough;

drawing a shuttle across the plurality of warp fibers in a direction substantially perpendicular to the warp fibers, the warp fibers defining a weave plane, the shuttle drawing a continuous weft fiber in a pass across the warp fibers;

arranging the heddles into groups, each group of heddles defining a layer including a subset of the warp fibers based on the warp fibers controlled by the respective heddle, the heddles in the group being controlled together as a unit such that shuttle passes either above or below all the warp fibers in in the group;

generating a plurality of portions based on the groups, each of the portions based on a woven area of a finished 3 dimensional structure;

joining each of the plurality of portions to at least one other of the plurality of portions by a respective linking yarn, the linking yarn configured to join portions at a non-planar juncture, the portions including a tongue;

accumulating the generated portions from accumulation of shuttle passes across drawn warp fibers based on the weaving instructions, accumulation of the portions including orienting warp fibers along a z-axis normal to the weave plane; and arranging the plurality of portions according to the non-planar junctions, each portion joined to one or more adjacent portions by the linking yarns, including forming the tongue as a top layer adjacent a right upper and a left upper based on a hinged juncture from a toe portion.

14. The method of claim 1 wherein the portions include at least a top right upper, a top left upper, and a tongue, further comprising forming the tongue as a separate layer above a layer defining the top right upper and the top left upper, the layer forming the tongue having a separate group of warp fibers than a group of warp fibers forming the top right upper and top left upper, the tongue attached at warp fibers shared with the hinged juncture, the tongue defined by weft fibers having a vertical component perpendicular to a weave plane.

15. The method of claim 14 further comprising a plurality of connecting wefts between the top right upper, top left upper and tongue layer, the connecting wefts engaging different groups of warp fibers corresponding to respective layers and adapted for subsequent trimming for layer separation of the tongue layer from the top right upper and top left upper layers.

16. The method of claim 1 further wherein the hinged juncture further comprising a tongue warp division forming distinct groups of warp fibers engaging alternate weft fibers, a group of weft fibers engaging the tongue layer having a selvedge.

17. The method of claim 14 further comprising forming an eyelet on the tongue layer, the eyelet defined by a float region, the float region running a weft fiber above a run of weft fibers for accumulating a free length of weft fibers responsive to a lace.

* * * * *